US010999665B2

(12) United States Patent
Huang et al.

(10) Patent No.: US 10,999,665 B2
(45) Date of Patent: May 4, 2021

(54) AUDIO SPEAKER WITH A VOICE COIL ASSEMBLY AND A METHOD OF MANUFACTURING THE SPEAKER

(71) Applicant: Guoguang Electric Corp. LTD, Guangzhou (CN)

(72) Inventors: Hanxiong Huang, Guangzhou (CN); Hongfei Zhao, Guangzhou (CN); George Shaolin Wei, San Diego, CA (US)

(73) Assignee: GUOGUANG ELECTRIC CORP. LTD., Guangzhou (CN)

( * ) Notice: Subject to any disclaimer, the term of this patent is extended or adjusted under 35 U.S.C. 154(b) by 0 days.

(21) Appl. No.: 16/695,016

(22) Filed: Nov. 25, 2019

(65) Prior Publication Data

US 2020/0169797 A1 May 28, 2020

Related U.S. Application Data

(63) Continuation of application No. 15/192,669, filed on Jun. 24, 2016, now abandoned.

(51) Int. Cl.

| | |
|---|---|
| ***H04R 1/06*** | (2006.01) |
| *H04R 31/00* | (2006.01) |
| *H04R 9/06* | (2006.01) |
| *H04R 9/02* | (2006.01) |

(52) U.S. Cl.

CPC ..... *H04R 1/06* (2013.01); *H04R 9/02* (2013.01); *H04R 9/06* (2013.01); *H04R 31/006* (2013.01)

(58) Field of Classification Search

CPC . H04R 1/06; H04R 9/04; H04R 9/043; H04R 9/045; H04R 9/046

See application file for complete search history.

(56) References Cited

U.S. PATENT DOCUMENTS

| | | | | |
|---|---|---|---|---|
| 1,872,261 A * | 8/1932 | Engholm | ..... | H04R 9/046 242/118.7 |
| 5,748,760 A * | 5/1998 | Button | ..... | H04R 9/022 381/400 |
| 7,035,424 B1 * | 4/2006 | Brandt | ..... | H04R 1/06 381/409 |
| 8,023,686 B2 * | 9/2011 | Huang | ..... | H04R 9/06 381/396 |

(Continued)

*Primary Examiner* — Ryan Robinson

(74) *Attorney, Agent, or Firm* — Loza & Loza, LLP; Julio M. Loza

(57) ABSTRACT

A speaker includes a frame, a magnetic circuit and a deflectable diaphragm. The frame supports the magnetic circuit and the deflectable diaphragm. The magnetic circuit includes a yoke, permanent magnet, top plate and a voice coil former. The voice coil former includes a voice coil wrapped around a lower portion of the perimeter. In an embodiment, an inner wall of T-Yoke forms a through hole along the height of the T-Yoke. A lead wire fixture is positioned at least partially within the through hole. The lead wire fixture includes a cable that is spliced or stripped into one or more lead wires that electrically couples with the voice coil. In an embodiment, the cable, the lead wire fixture, and the lead wires are pre-assembled or integrated into a component. This integration helps to reduce the height and width of the speaker and helps to create a more compact speaker.

16 Claims, 10 Drawing Sheets

(56) References Cited

U.S. PATENT DOCUMENTS

| | | | | |
|---|---|---|---|---|
| 9,020,178 | B2 * | 4/2015 | Martikainen | H04R 1/025 381/332 |
| 9,084,056 | B2 * | 7/2015 | Flavignard | H04R 1/24 |
| 9,137,607 | B2 * | 9/2015 | Stead | H04R 7/20 |
| 9,628,884 | B2 * | 4/2017 | Pare | H04R 1/06 |
| 2011/0222721 | A1 * | 9/2011 | Matsuda | H04R 9/046 381/412 |

* cited by examiner

AUDIO SPEAKER WITH A VOICE COIL ASSEMBLY AND A METHOD OF MANUFACTURING THE SPEAKER

CLAIM OF PRIORITY UNDER 35 U.S.C. § 119

The present application claims priority under 35 U.S.C. § 119 to Chinese Patent Application No. 201520450982.4, filed Jun. 29, 2015, and hereby expressly incorporated by reference herein.

FIELD

This application relates to the field of audio speakers and/or loudspeakers, and more particularly to speakers having an inner lead wire system.

BACKGROUND

Conventional speakers produce audible sounds by displacing air via the movement of a diaphragm. Specifically, the diaphragm (e.g., often referred to as a dome, membrane, cone, etc.) is attached to a voice coil former (sometimes also referred to as a bobbin) and moves under the control of a voice coil through which electric current associated with the sounds to be reproduced. The voice coil is typically disposed in an annular air gap defined by a permanent magnet that provides radial magnetic flux in the air gap. Lead wires provide the electric current to the voice coil which interacts with this magnetic flux to provide axial forces on the voice coil and voice coil former which displace the voice coil, former, and the diaphragm (e.g., causing an up and/or down movement along an central axis). The displacement or movement of the voice coil and former may be controlled by the magnitude and direction of current in the voice coil and the resulting axial forces.

Typically, speaker lead wires are routed from the voice coils along the voice coil former, and either through or beneath the diaphragm to an input terminal board connector. The lead wires are generally single strand wires connected to the voice coil which are then attached to flexible cables. The voice coil wires are affixed to the voice coil former and routed along the former to a location above the diaphragm where the wires are spliced to the cables. The cables are typically routed outside of the voice coil and along the diaphragm, through an aperture or hole therein, and terminated at an external electrical connector.

However, this routing of the cables outside of the voice coil requires additional space within the speaker. Recent advancements in speaker technology have created a need for smaller and more compact speakers. Thus, there is a need to reduce the size of a speaker, and make the speaker more compact.

SUMMARY

According to a first aspect, a speaker includes a T-shaped or U-shaped yoke and a permanent magnet, wherein the yoke and the permanent magnet define a magnetic gap. A voice coil former including a voice coil wrapped around an outside perimeter is positioned at least partially within the magnetic gap. A frame is positioned around the voice coil former and supports a deflectable diaphragm. The speaker also includes an integrated voice coil assembly. The integrated voice coil assembly includes a cable that is stripped and/or spliced to form at least two lead wires; and a lead wire fixture positioned within the voice coil former, wherein the lead wire fixture holds the cable and the at least two lead wires. The two lead wires extend from a top portion of the lead wire fixture inside the voice coil former and are coupled to the voice coil wrapped around an outside perimeter of the voice coil former through one or more apertures in the voice coil former. A base plate of the yoke forms a groove along a width direction of the base plate to an outer edge of the yoke. The cable is positioned within the groove and is guided from the bottom portion of the lead wire fixture to the outer edge of the yoke.

According to a second aspect, a speaker includes a deflectable diaphragm, a frame for supporting the diaphragm and a magnetic circuit. The magnetic circuit includes a yoke and a permanent magnet, wherein the yoke and the permanent magnet define a magnetic gap. The magnetic circuit further includes a voice coil former including a voice coil that is positioned at least partially within the magnetic gap for deflecting the diaphragm to generate sound waves. The magnetic circuit also includes a voice coil assembly including a cable, at least two lead wires, wherein the at least two lead wires are coupled to the voice coil through one or more apertures in the voice coil former; and a lead wire fixture positioned within the voice coil former, wherein the lead wire fixture holds the cable and at least two lead wires.

In one or more of the above aspects, the yoke is a T-Yoke that forms a through hole along a height of the T-Yoke, and the lead wire fixture is positioned within the through hole of the T-Yoke.

In one or more of the above aspects, the yoke is a U-Yoke wherein the permanent magnet and the top plate are positioned within the U-Yoke and above a bottom piece of the U-Yoke. A through hole is formed by an inner wall of the bottom piece of the U-Yoke and an inner wall of the permanent magnet and the top plate such that the through hole extends along the height of the U-Yoke, the permanent magnet and the top plate. The the lead wire fixture is positioned at least partially within the through hole.

According to a third aspect 18, a method of manufacturing a speaker includes assembling a voice coil assembly, wherein the voice coil assembly includes a cable; at least two lead wires, and a lead wire fixture configured to hold the cable and the at least two lead wires. The method of manufacture further includes assembling a magnetic circuit, wherein the magnetic circuit includes a yoke, a top plate and a permanent magnet, wherein a magnetic gap is formed between the yoke and the top plate and the permanent magnet and wherein the voice coil assembly is positioned within a through hole of the yoke. The method of manufacture further includes installing a voice coil former having a voice coil wrapped around an outside perimeter at least partially within the magnetic gap, wherein the voice coil assembly in the through hole of the yoke is positioned within the voice coil former. The method further includes coupling the at least two lead wires to the voice coil wrapped around the outside perimeter of the voice coil former through one or more apertures in the voice coil former.

DETAILED DESCRIPTION

The word "exemplary" or "embodiment" is used herein to mean "serving as an example, instance, or illustration." Any implementation or aspect described herein as "exemplary" or as an "embodiment" is not necessarily to be construed as preferred or advantageous over other aspects of the disclosure. Likewise, the term "aspects" does not require that all aspects of the disclosure include the discussed feature, advantage, or mode of operation.

Embodiments will now be described in detail with reference to the accompanying drawings. In the following description, numerous specific details are set forth in order to provide a thorough understanding of the aspects described herein. It will be apparent, however, to one skilled in the art, that these and other aspects may be practiced without some or all of these specific details. In addition, well known steps in a method of a process may be omitted from flow diagrams presented herein in order not to obscure the aspects of the disclosure. Similarly, well known components in a device may be omitted from figures and descriptions thereof presented herein in order not to obscure the aspects of the disclosure.

Overview

A speaker includes a frame, a magnetic circuit and a deflectable diaphragm. The frame supports the magnetic circuit and the deflectable diaphragm. The magnetic circuit includes a T-Yoke, permanent magnet and a top plate. A voice coil former is positioned between an outer wall of the T-Yoke and the top plate and the magnet. The voice coil former is a ferrous or other conductive material and includes a voice coil wrapped around a lower portion of the perimeter. In an embodiment, an inner wall of T-Yoke forms a through hole along the height of the T-Yoke. A lead wire fixture is positioned at least partially within the through hole. The lead wire fixture includes a cable that is spliced or stripped into one or more lead wires that electrically couples with the voice coil. A second end of the cable extends from the bottom of the through hole to an external electrical connection.

In an embodiment, the cable, the lead wire fixture, and the lead wires are pre-assembled or integrated into a component. This integration helps to reduce the height and width of the speaker and helps to create a more compact speaker. The manufacturing cost of the speaker may also be reduced.

Exemplary Embodiments

Figure 1:
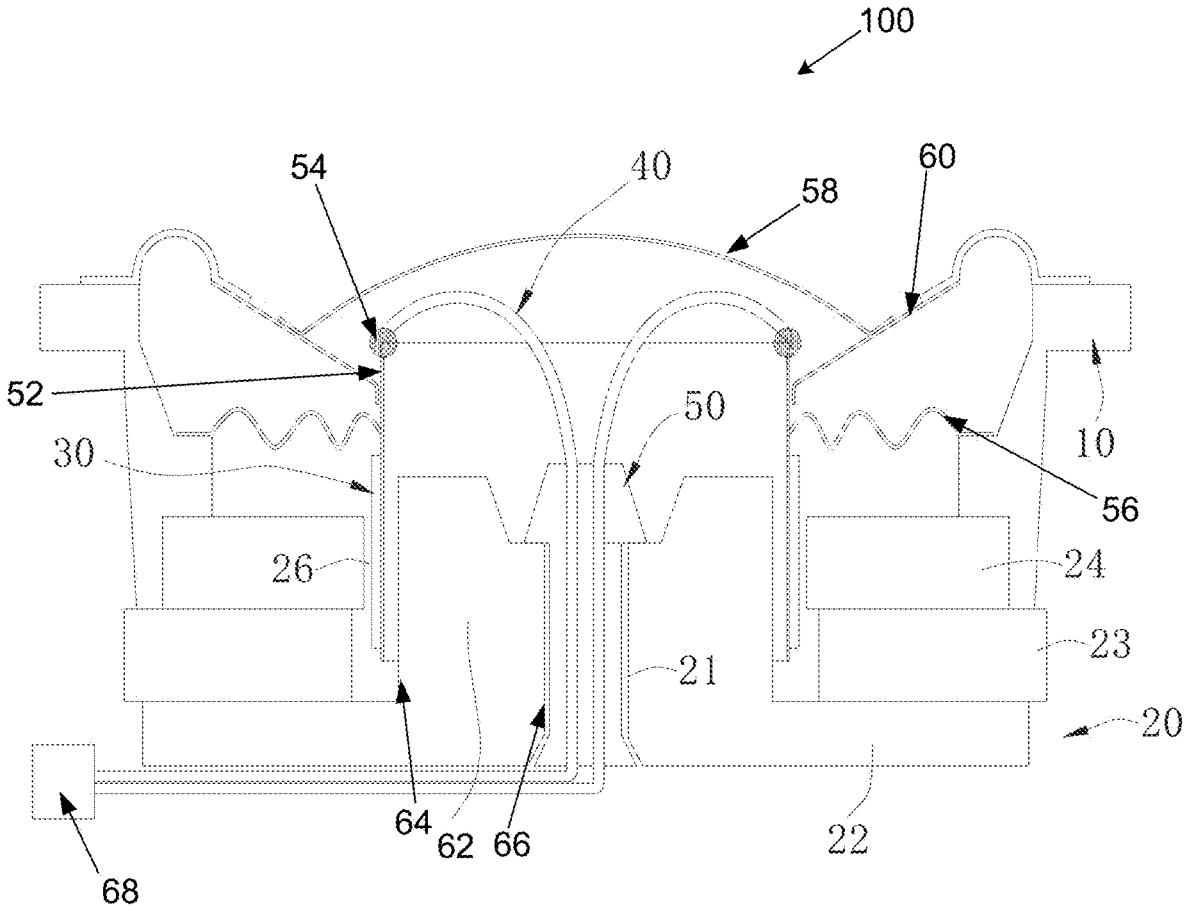
FIG. 1 illustrates an exemplary embodiment of a cross-sectional view of a speaker.

FIG. 1 illustrates an exemplary embodiment of a cross-sectional view of a speaker 100. The speaker 100 includes a frame 10, a magnetic circuit 20 and a deflectable diaphragm 60. The frame 10 supports the magnetic circuit 20 and the deflectable diaphragm 60. The frame 10 may also support a spider 56 and dust cap 58. The dust cap 58 is generally positioned above the diaphragm 60 for protection of the magnetic circuit 20.

The magnetic circuit 20 includes a T-Yoke 22, permanent magnet 23 and a top plate 24. The T-Yoke 22 has a cylindrical pole piece 62 with an inner wall 64 and outer wall 66. A voice coil former 52 is positioned between the outer wall 66 of the T-Yoke 22 and the top plate 24 and the magnet 23. The voice coil former 52 is a ferrous or other conductive material and includes a voice coil 30 wrapped around a lower portion of the perimeter. The outer wall 66 of the T-Yoke 22 defines an annular gap 26 within which the voice coil former 52 and the voice coil 30 may move. The top plate 28 and permanent magnet 22 define the outer diameter of the annular gap 26.

In an embodiment, the inner wall 64 of the cylindrical pole piece 62 forms a through hole 21 along the height of the T-Yoke 22. An integrated lead wire fixture 50 is positioned at least partially within the through hole 21 and inside the voice coil former 52. The lead wire fixture 50 holds a cable 40 having a first endpoint 54 that electrically couples with the voice coil 30, and a second endpoint that extends from the bottom of the through hole 21 to an external electrical connection 68. A protective covering 70 may surround the cable 40 external to the T-Yoke 22. The protective covering 70 protects the cable 40 and holds the cable 40 together.

In use, the voice coil 30 behaves as an electromagnet. By running an electrical current through the voice coil 30, a magnetic field is produced surrounding the voice coil 30. This magnetic field magnetizes the metal of the voice coil former 52 creating north and south polar orientations. The polar orientations may be switched by reversing the current's flow through the voice coil 30.

The speaker 100 uses this electromagnetic property of the voice coil 30 to repeatedly reverse the electrical flow and switch the polar orientations of the magnetic field. The voice coil's electromagnetic field interacts with the magnetic field of the permanent magnet 23. When the magnetic polarity of the voice coil 30 changes, the permanent magnet and the voice coil former 52 are repeatedly repelled and attracted. They move the voice coil 30 back and forth quickly, like the piston in an engine. The moving voice coil 30 presses and pulls on the voice coil former 52 which in turn vibrates the deflectable diaphragm 60. This vibration of the deflectable diaphragm 60 creates sound waves that are emitted from the speaker 100. The speaker 100 is thus able to generate sound in response to an electrical current.

Figure 2:
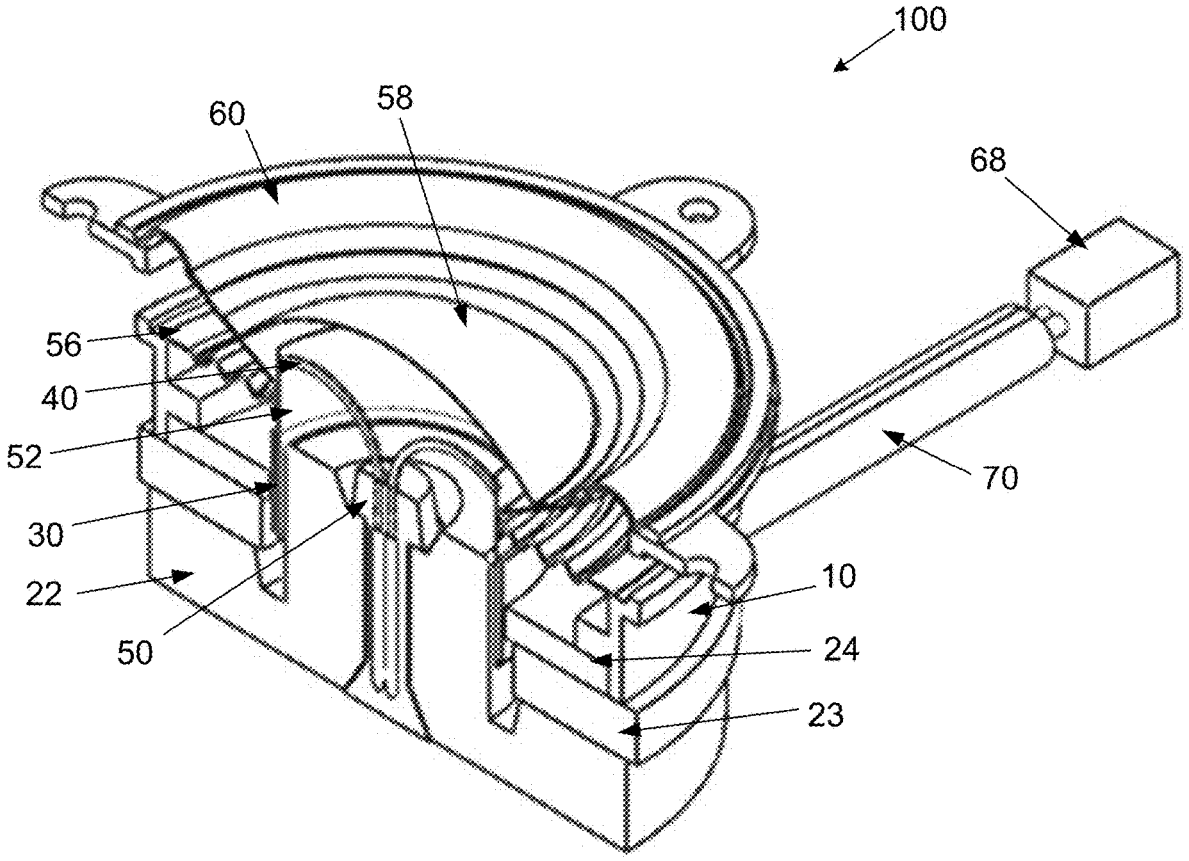
FIG. 2 illustrates an exemplary embodiment of a side elevational view of the speaker.

FIG. 2 illustrates a side elevational view of the speaker 100. The side elevational view illustrates the cable 40 passing through the lead wire fixture 50 to an upper portion of the voice coil former 52. The upper portion of the voice coil former 52 includes an aperture 58 through which one or more leads from the cable 40 are electrically coupled with the voice coil 30. Another end of the cable 40 exits a bottom portion of the lead wire fixture 50 and leads to the external cable electrical connection 68.

In an embodiment, at least the cable 40, the lead wire fixture 50, and one or more leads from the cable 40 are integrated or combined into a single package or assembly. The external electrical connection 68 and the protective covering 70 may also be included in the assembly. This assembly of parts are combined for more compact installation in the speaker. This integration helps to reduce the height and width of the speaker 100 and helps to create a more compact speaker 100. The manufacturing cost of the speaker 100 may be reduced as well.

Figure 3:
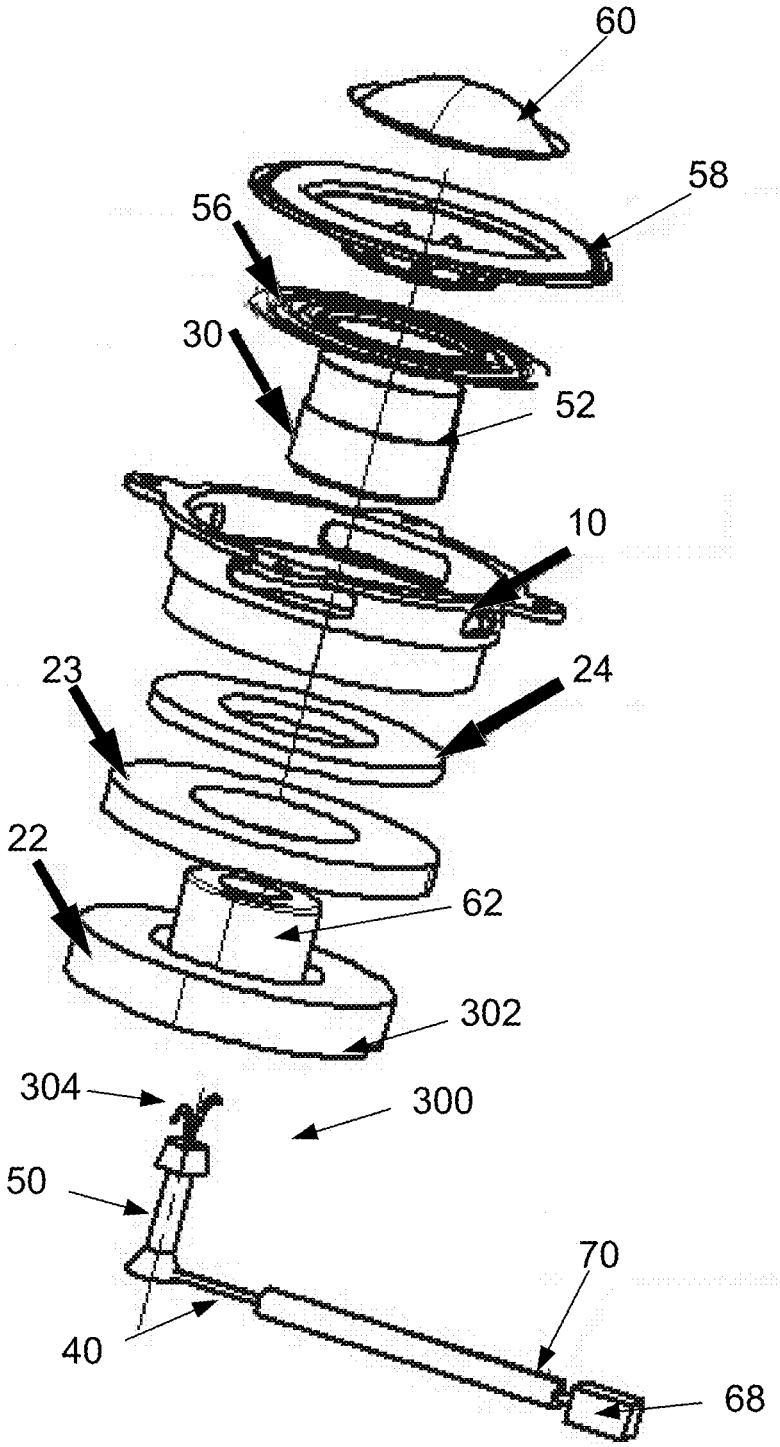
FIG. 3 illustrates an exemplary embodiment of an exploded isometric view of a speaker.

FIG. 3 illustrates an embodiment of an exploded view of parts of the speaker 100. An embodiment of the integrated voice coil assembly 300 is illustrated. In an embodiment, the voice coil assembly 300 includes the cable 40, the lead wire fixture 50, and one or more leads 304. The cable 40 is stripped and/or spliced to form the one or more leads 304. The voice coil assembly 300 may also include the external connection 68 and the protective covering 70. The voice coil assembly 300 is positioned at least partially in the through hole 21 of the T-Yoke 22.

In an embodiment, a groove 302 is formed on the bottom of the T-Yoke 22 from the through hole 21 along the width direction of the T-Yoke 22 to the outer edge of the T-Yoke 22. The cable 40 fits within the groove 302 and guides the cable 40 from the bottom of the through hole 21 to the outer edge of T-Yoke 22. By positioning the cable 40 in the groove 302 of the T-Yoke, additional space that would be needed for the cable 40 below the T-Yoke 22 is saved. This improvement may also help to reduce the height of the speaker and make the speaker more compact.

The permanent magnet 22 and top plate 23 are positioned over the T-Yoke 22. The voice coil former 52 is positioned between the cylindrical pole piece 62 and the permanent magnet 22 and top plate 23. The frame 10 supports the voice coil former 52, spider 56 and diaphragm 60. The dust cap 58 is positioned over the diaphragm 60 to protect the components underneath.

Figure 4:
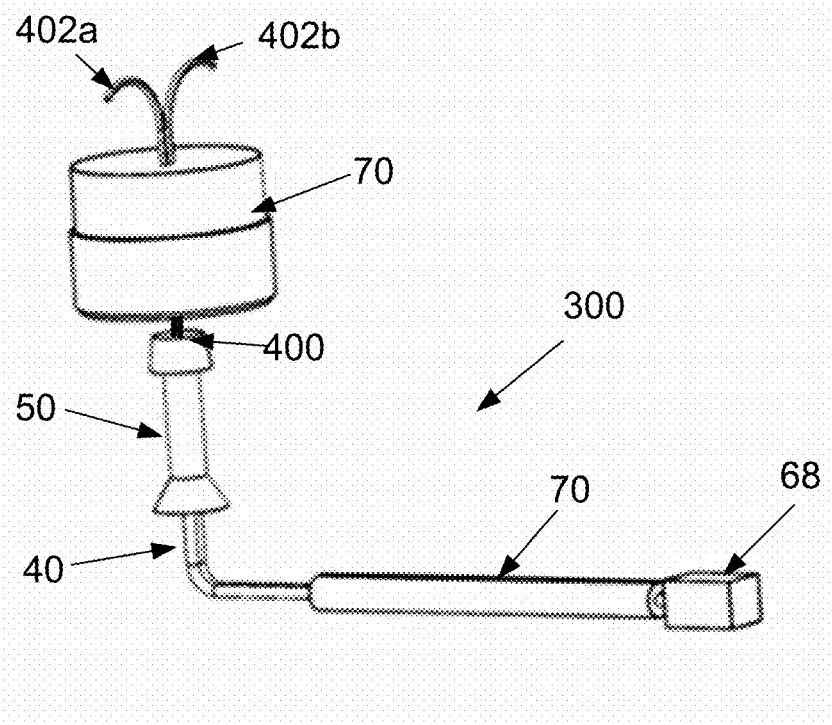
FIG. 4 illustrates an exemplary embodiment of an integrated voice coil assembly.

FIG. 4 illustrates an embodiment of the integrated voice coil assembly 300. The lead wire fixture 50 includes a passageway or inner spacing 400 that extends vertically from the top to the bottom of the lead wire fixture 50. Cable 40 is threaded or positioned through the passageway 400 of the lead wire fixture 50 into the voice coil former 70. The cable 40 may be stripped and/or spliced to form at least two lead wires 402*a*, 402*b*. The lead wires 402*a*, 402*b* extend from the top of the passageway 400 and electrically couple with the voice coil 30.

In other embodiments, the cable 40 may be spliced to include another multiple of two, such as 4, 6, or 8 lead wires 402. For example, the voice coil 30 may comprise of more than one coil or wire. Two lead wires 402 are then needed to couple to any separate wires or coils in the voice coil 30. For example, when the voice coil 30 includes two separate wires or coils, then four lead wires 402 may be implemented for coupling to the two separate wires or coils in the voice coil 30.

A second end of the cable 40 extends from the bottom of the passageway 400 to connect to the external electrical connection 68. In this embodiment, the voice coil assembly 300 includes for example the cable 40, the lead wire fixture 50, and the spliced lead wires 402*a*, 402*b*. The voice coil assembly may also include the external connection 68 and the protective covering 70.

Figure 5:
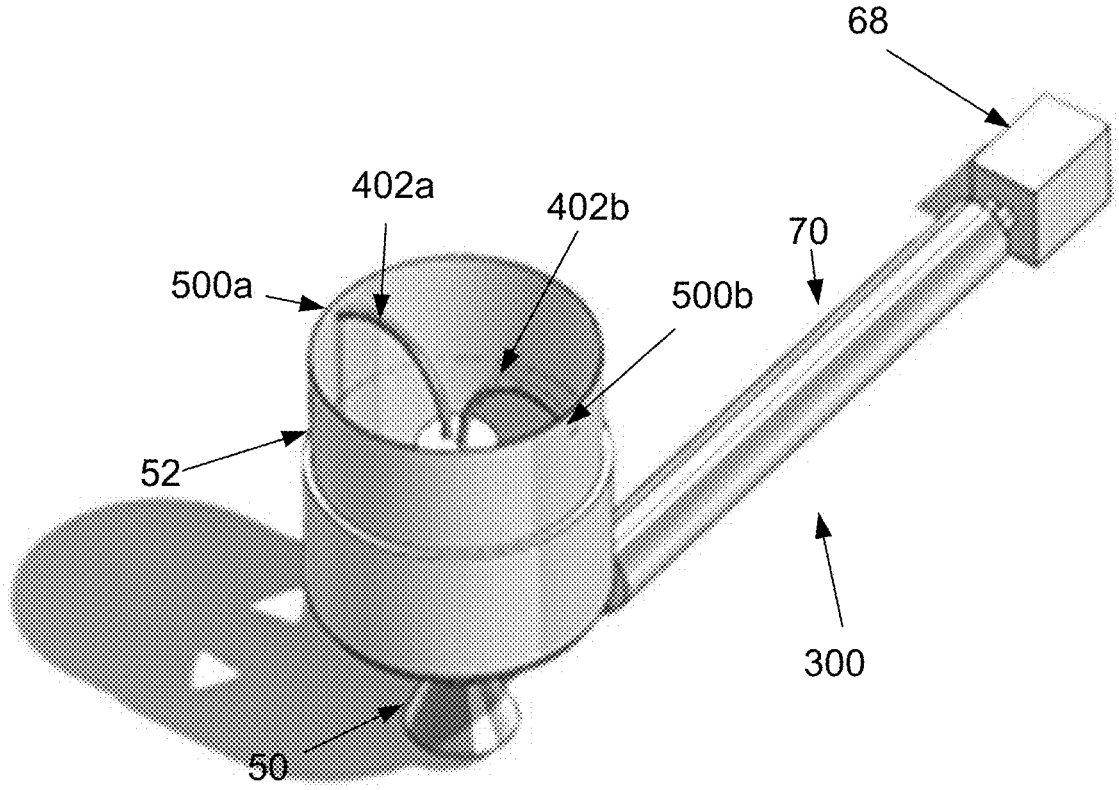
FIG. 5 illustrates another exemplary embodiment of the integrated voice coil assembly.

FIG. 5 illustrates another exemplary embodiment of the voice coil assembly 300 coupled to the voice coil former 52. In an embodiment, the voice coil former 52 forms at least a first aperture 500*a*, preferably in an upper portion of the voice coil former 52. One of the lead wires 402*a* is positioned or threaded through the aperture 500*a* for electrical coupling to a first end of the voice coil 30. The voice coil former 52 may also form a second aperture 500*b*, preferably in the upper portion of the voice coil former 52. Another one of the lead wires 402*b* is positioned through the second aperture 500*b* for electrical coupling to a second end of the voice coil 30.

Figure 6:
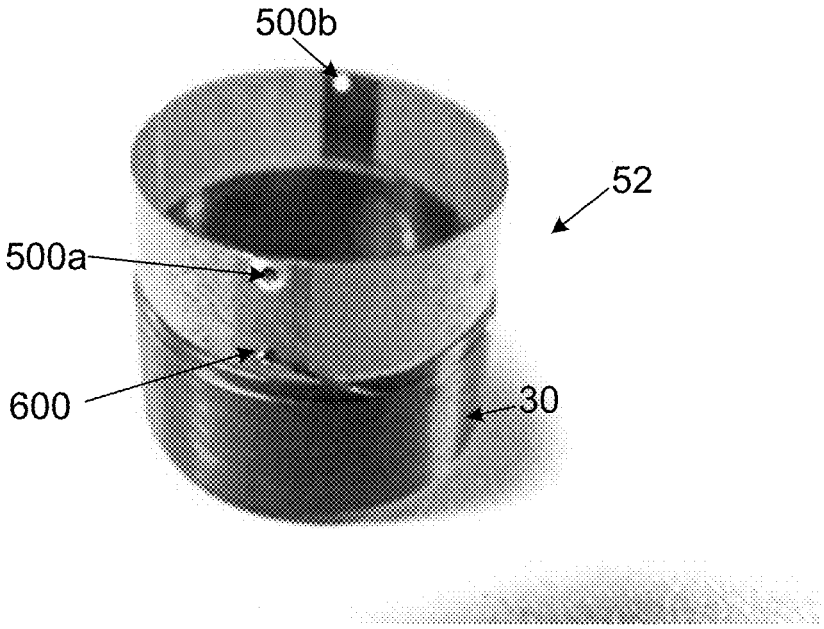
FIG. 6 illustrates an exemplary embodiment of a voice coil former.

FIG. 6 illustrates an exemplary embodiment of the voice coil former 52 in more detail. The voice coil 30 is wrapped around a lower portion of the voice coil former 52. A first end of the voice coil 30 is attached to a terminal 600. The voice coil former 52 forms at least a first aperture 500*a*, preferably in an upper portion of the voice coil former 52. In an embodiment, one of the lead wires 402*a* shown in previous FIGS. 4 and 5 is positioned through the first aperture 500*a* for electrical coupling to the first end of the voice coil 30 at terminal 600. In another embodiment, another wire or conductive material is electrically coupled to the terminal point 600 and is positioned through the aperture 500 into the interior of the voice coil former 52 for attachment to one of the lead wires 402*a*.

Similarly, a second end of the voice coil 30 may be attached to a second terminal 600 (not shown). The voice coil former 52 forms at least a second aperture 500*b*, preferably in the upper portion of the voice coil former 52. In an embodiment, the other one of the lead wires 402*b* shown in previous FIGS. 4 and 5 is positioned through the second aperture 500*b* for electrical coupling to a second end of the voice coil 30 at the second terminal 600.

Figure 7A:
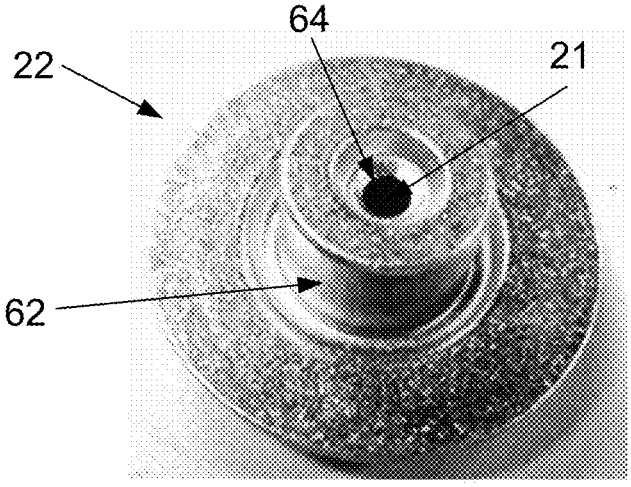
FIG. 7A illustrates an exemplary embodiment of a perspective view of a T-Yoke.
Figure 7B:
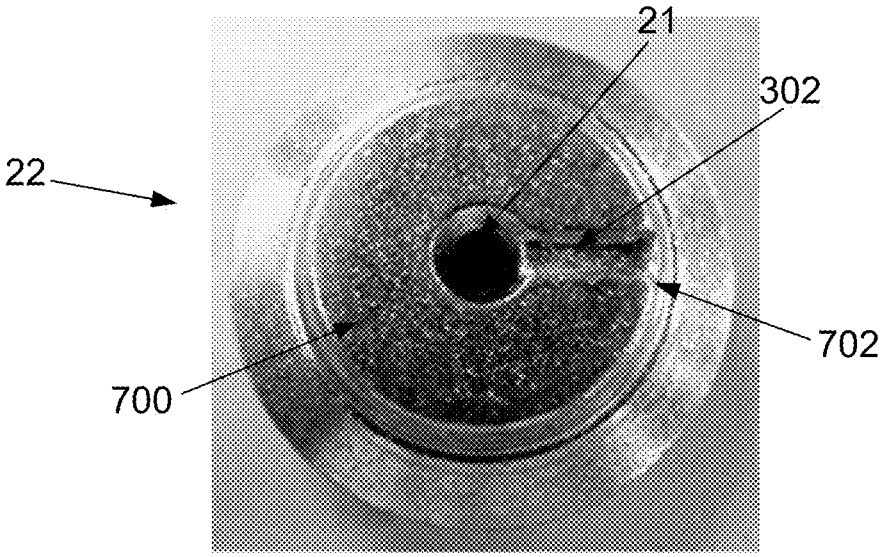
FIG. 7B illustrates an exemplary embodiment of a bottom view of the T-Yoke.

FIG. 7A and FIG. 7B illustrate an exemplary embodiment of the T-Yoke 22. FIG. 7A illustrates a perspective top view of the T-Yoke 22. The T-Yoke 22 includes the cylindrical pole piece 62. The inner wall 64 of the cylindrical pole piece 62 forms the through hole 21 along the height of the T-Yoke 22. The lead wire fixture 50 is positioned within the through hole 21.

FIG. 7B illustrates a perspective bottom view of the T-Yoke 22. The T-Yoke includes a base plate 700 that forms the groove 302. In an embodiment, the cable 40 fits within the groove 302 and is guided from the through hole 21 to the outer edge 702 of T-Yoke 22. By positioning the cable 40 in the groove 302 of the T-Yoke, additional space that would be needed for the cable 40 below the T-Yoke 22 is saved. This improvement may help to reduce the height of the speaker and make the speaker more compact.

Figure 8:
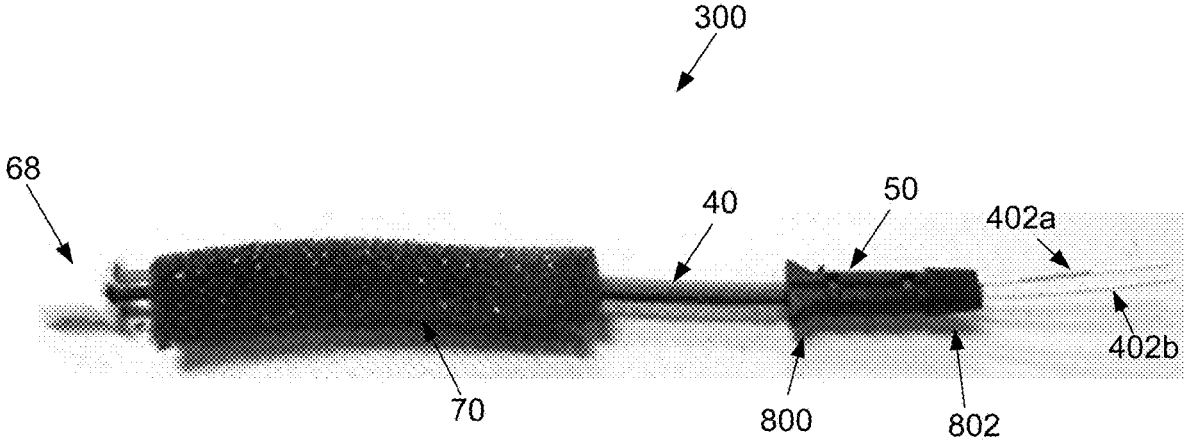
FIG. 8 illustrates an exemplary embodiment of a cable wire.

FIG. 8 illustrates another exemplary embodiment of the voice coil assembly 300. The cable 40 enters at a bottom portion 800 of the lead wire fixture 50. The lead wire fixture 50 holds or supports the cable and routes the cable 40 to a top portion 802 of the lead wire fixture 50. The cable 40 may be stripped and/or spliced to form at least two lead wires 402*a*, 402*b*. The lead wires 402*a*, 402*b* extend from the top portion 802 of the lead wire fixture 50. The lead wires 402*a*, 402*b* may then be electrically coupled to the voice coil 30.

The cable 40 extends from the bottom portion 800 of the lead wire fixture 50 to connect to the external electrical connection 68. The protective covering 70 holds and protects the cable 40 to the electrical connection 68. The integrated voice coil assembly 300 includes for example the cable 40, the lead wire fixture 50, as well as the spliced lead wires 402*a*, 402*b*. The external connection 68 and the protective covering 70 may also be included in the integrated voice coil assembly 300.

Figure 9:
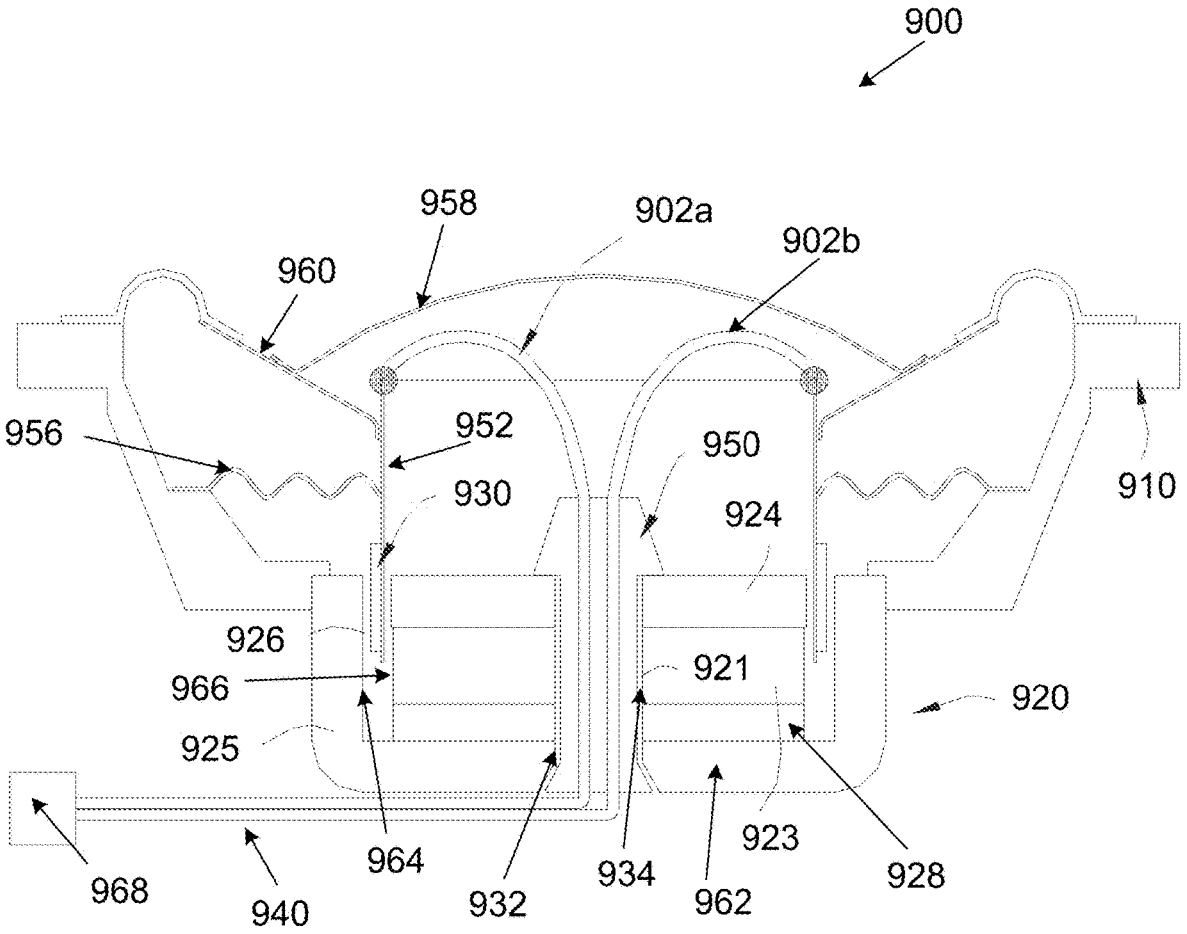
FIG. 9 illustrates another exemplary embodiment of a cross-sectional view of the speaker.

FIG. 9 illustrates another exemplary embodiment of a cross-sectional view of a speaker 900. As shown in FIG. 9, the speaker 900 includes an inner magnetic circuit 920 having a U-Yoke 925 rather than a T-Yoke 22. In this embodiment, the permanent magnet 923 and the top plate 924 are installed in the inside of the U-Yoke 925 above a bottom piece 962 of the U-Yoke. The top plate 924 is located above the magnet 923, and an optional bottom plate 928 is located below the magnet 923. An annular gap 926 is formed between the top plate 924, the permanent magnet 923 and the U-Yoke 925. An outer wall 966 of the top plate 924 and the permanent magnet 923 define the inner diameter of the annular gap 926 while the inner wall 964 of the U-Yoke 925 defines the outer diameter of the annular gap 926. The voice coil 930 is installed inside of the U-Yoke 925 and located within the annular gap 926.

The frame 910 supports the voice coil former 952, the spider 956 and the deflectable diaphragm 960. A dust cap 958 may be positioned above the deflectable diaphragm 960 to protect the magnetic circuit 920.

The optional bottom plate 928, the permanent magnet 923, the top plate 924 and the U-Yoke 925 form a through hole 921. For example, an inner wall 932 of the bottom piece 962 of the U-Yoke 925 forms a portion of the through hole 921. An inner wall 934 of the bottom plate 928, the permanent magnet 923 and the top plate 924 forms another portion of the through hole 921. Thus, the through hole 921 is formed along the height of the U-Yoke 925, the optional bottom plate 928, the permanent magnet 923 and the top plate 924.

An integrated lead wire fixture 950 is positioned at least partially within the through hole 921. The lead wire fixture 950 includes the cable 940 having a first endpoint that electrically couples with the voice coil 930, and a second endpoint that extends from the bottom of the through hole 921 to an external electrical connection 968. A protective covering (not shown) may surround the cable 940 external to the U-Yoke 925.

In an embodiment, at least the cable 940, the lead wire fixture 950, and the external electrical connection 968 are integrated or combined into a single package or assembly. The protective covering (not shown) over the cable 940 may also be included in the assembly. This assembly of parts is combined for more compact installation in the speaker 900. This integration helps to reduce the height and width of the speaker 900 and helps to create a more compact speaker 900. The manufacturing cost of the speaker 900 may be reduced as well.

Similarly to the T-Yoke 22, a groove (not shown) may be formed in the bottom piece of the U-Yoke 925 from the through hole 921 to the external edge of the U-Yoke 925 along the width direction of the U-Yoke 925. The cable 940 can be housed within the groove such that the cable 940 does not need to take additional space below the U-Yoke 925. The groove thus saves further space for the structure of the speaker 900.

In use, the voice coil 930 behaves as an electromagnet. When an electrical current runs through the voice coil 930, a magnetic field is produced surrounding the voice coil 930. This magnetic field magnetizes the metal of the voice coil former 952 creating north and south polar orientations. The polar orientations may be switched by reversing the current's flow through the voice coil 930.

The speaker 900 uses this electromagnetic property of the voice coil 930 to repeatedly reverse the electrical flow and switch the polar orientations of the magnetic field. The electromagnetic field of the voice coil 930 interacts with the magnetic field of the permanent magnet 923. When the magnetic polarity of the the voice coil 930 changes, the permanent magnet 923 and the voice coil former 952 are repeatedly repelled and attracted. They move the voice coil 930 back and forth quickly inside the annular gap 926. The moving voice coil 930 presses and pulls on the voice coil former 952 which in turn vibrates the deflectable diaphragm 960. This vibration of the deflectable diaphragm 960 creates sound waves that are emitted from the speaker 900. The speaker 900 is thus able to generate sound in response to an electrical current.

Figure 10:
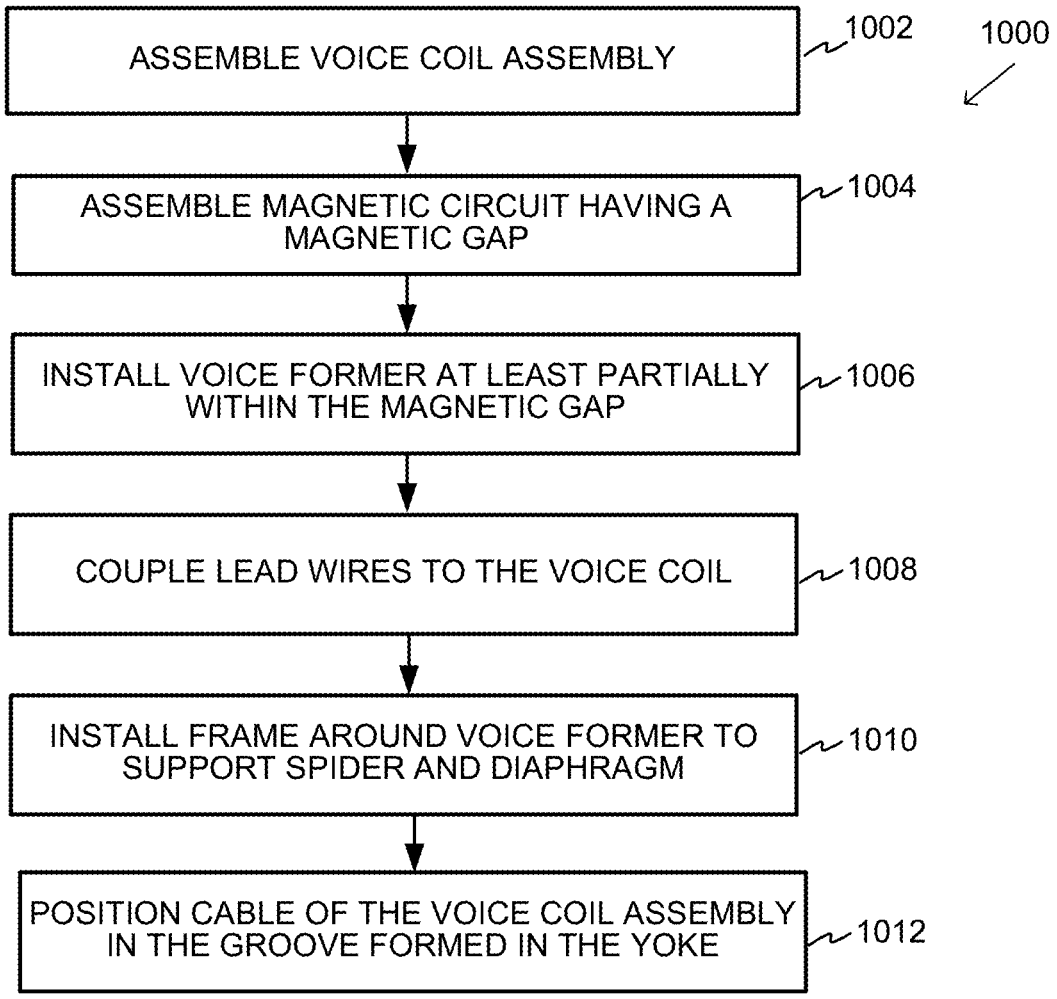
FIG. 10 illustrates a logical flow diagram of an exemplary method for manufacturing a loudspeaker.

FIG. 10 illustrates a logical flow diagram of an exemplary method 1000 for manufacturing a speaker. A voice coil assembly is assembled or integrated in step 1002. The voice coil assembly includes the lead wire fixture, the cable, and the lead wires for connection to the voice coil wrapped around the voice coil former. The voice coil assembly may also include the external electrical connection and the protective covering. The magnetic circuit is then assembled 1004. The magnetic circuit includes a top plate, a permanent magnet and a yoke wherein a magnetic gap is defined between the top plate permanent magnet ad the yoke. The yoke has a through hole formed therein, and the lead wire fixture of the voice coil assembly is installed such that the lead wire fixture is positioned at least partially in the through hole formed in the yoke.

The voice coil former is then installed at least partially within the magnetic gap 1006. When a T-Yoke is implemented, the voice coil former is installed outside the T-Yoke and between the T-Yoke and the permanent magnet and top plate. When a U-Yoke is implemented, the voice coil former is installed within the U-Yoke and between the U-Yoke and the permanent magnet and top plate.

The method of manufacture then includes that the lead wires of the voice coil assembly are electrically coupled to the voice coil 1008. The lead wires extend from a top portion of the voice coil assembly inside the voice coil former. The lead wires are threaded or extended through one or more apertures in the voice coil former to couple to the voice coil.

The frame, spider and diaphragm are assembled around the voice coil former 1010. A dust cap may be positioned over the diaphragm as well. The cable of the voice coil assembly may be positioned within the groove formed in the bottom of the yoke 1012.

In one or more embodiments, a speaker includes a voice coil assembly of parts. The voice coil assembly includes at least a cable, lead wire fixture and lead wires for connection to a voice coil. The voice coil assembly allows for a more compact installation in the speaker. This integration helps to reduce the height and width of the speaker and helps to create a more compact speaker. The manufacturing cost of the speaker may also be reduced. In one or more other embodiments, a groove may be formed in the bottom piece of a yoke in the speaker from the through hole to the external edge of the yoke. The cable of the voice coil assembly can be housed in the groove and save further space for the structure of the speaker.

As may be used herein, the term "operable to" or "configurable to" indicates that an element includes one or more of circuits, instructions, modules, data, input(s), output(s), etc., to perform one or more of the described or necessary corresponding functions and may further include inferred coupling to one or more other items to perform the described or necessary corresponding functions. As may also be used herein, the term(s) "coupled", "coupled to", "connected to" and/or "connecting" or "interconnecting" includes direct connection or link between nodes/devices and/or indirect connection between nodes/devices via an intervening item (e.g., an item includes, but is not limited to, a component, an element, a circuit, a module, a node, device, network element, etc.). As may further be used herein, inferred connections (i.e., where one element is connected to another element by inference) includes direct and indirect connection between two items in the same manner as "connected to".

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, frequencies, wavelengths, component values, integrated circuit process variations, temperature variations, rise and fall times, and/or thermal noise. Such relativity between items ranges from a difference of a few percent to magnitude differences.

Note that the aspects of the present disclosure may be described herein as a process that is depicted as a schematic, a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

The various features of the disclosure described herein can be implemented in different systems and devices without departing from the disclosure. It should be noted that the foregoing aspects of the disclosure are merely examples and are not to be construed as limiting the disclosure. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

In the foregoing specification, certain representative aspects of the invention have been described with reference to specific examples. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described. For example, the components and/or elements recited in any apparatus claims may be assembled or otherwise operationally configured in a variety of permutations and are accordingly not limited to the specific configuration recited in the claims.

Furthermore, certain benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a nonexclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

Moreover, reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is intended to be construed under the provisions of 35 U.S.C. § 112(f) as a "means-plus-function" type element, unless the element is expressly recited using the phrase "means for" or, in the case of a method claim, the element is recited using the phrase "step for."

What is claimed is:

1. A speaker, comprising:

a yoke;

a permanent magnet, wherein the yoke and the permanent magnet define a magnetic gap;

a voice coil former including a voice coil at a first end and positioned at least partially within the magnetic gap; and an integrated voice coil assembly including:

a cable including at least two lead wires;

the at least two lead wires-coupled to the voice coil inside the voice coil former through one or more apertures at a second end of the voice coil former; and a lead wire guide fixture defining a passageway through which the cable passes and extends from outside the first end of the voice coil former into an interior space of the voice coil former; and a connector to which the at least two lead wires are coupled outside the voice coil former.

2. The speaker of claim 1, wherein the cable is partially supported by and routed into a bottom portion of the lead wire guide fixture; and wherein the cable is stripped to form the at least two lead wires.

3. The speaker of claim 2, wherein the two lead wires extend from a top portion of the lead wire guide fixture.

4. The speaker of claim 3, wherein a base plate of the yoke forms a groove along a width direction of the base plate to an outer edge of the yoke; and wherein the cable is positioned within the groove and is guided from the bottom portion of the lead wire guide fixture to the outer edge of the yoke.

5. The speaker of claim 4, wherein the yoke is a T-Yoke that forms a through hole along a height of the T-Yoke; and wherein the lead wire guide fixture is positioned within the through hole of the T-Yoke.

6. The speaker of claim 5, further comprising:

a top plate positioned above the permanent magnet; and wherein the voice coil former is positioned at least partially within the magnetic gap formed between the T-Yoke and the permanent magnet and the top plate.

7. The speaker of claim 4, wherein the yoke is a U-Yoke; and wherein the permanent magnet and the top plate are positioned within the U-Yoke and above a bottom piece of the U-Yoke.

8. The speaker of claim 7, wherein the magnetic gap is formed between an inner wall of the U-Yoke and an outer wall of the permanent magnet and the top plate.

9. The speaker of claim 8, wherein a through hole is formed by an inner wall of the bottom piece of the U-Yoke and an inner wall of the permanent magnet and the top plate and wherein the through hole extends along the height of the U-Yoke, the permanent magnet and the top plate.

10. The speaker of claim 9, wherein the lead wire guide fixture is positioned at least partially within the through hole.

11. A speaker, comprising:

a deflectable diaphragm;

a frame for supporting the diaphragm;

a magnetic circuit, including:

a yoke;

a permanent magnet, wherein the yoke and the permanent magnet defines a magnetic gap;

a voice coil former including a voice coil at a second end and positioned at least partially within the magnetic gap for deflecting the diaphragm to generate sound waves; and an integrated voice coil assembly including:

a cable including at least two lead wires;

the at least two lead wires-coupled to the voice coil inside the voice coil former through one or more apertures at a second end of the voice coil former; and a lead wire guide fixture defining a passageway through which the cable passes and extends from outside the first end of the voice coil former into an interior space of the voice coil former;

a connector to which the at least two lead wires are coupled outside the voice coil former.

12. The speaker of claim 11, wherein the cable is partially supported by and routed into a bottom portion of the lead wire guide fixture; and wherein the cable is stripped to form the at least two lead wires.

13. The speaker of claim 12, wherein the two lead wires extend from a top portion of the lead wire guide fixture.

14. The speaker of claim 13, wherein a base plate of the yoke forms a groove along a width direction of the base plate to an outer edge of the yoke; and wherein the cable is positioned within the groove and is guided from the bottom portion of the lead wire guide fixture to the outer edge of the yoke.

15. The speaker of claim 14, wherein the yoke is a T-Yoke that forms a through hole along a height of the T-Yoke; and wherein the lead wire guide fixture is positioned within the through hole of the T-Yoke.

16. The speaker of claim 14, wherein the yoke is a U-Yoke; and wherein the permanent magnet and a top plate are positioned within the U-Yoke and above a bottom piece of the U-Yoke;

wherein a through hole is formed by an inner wall of the bottom piece of the U-Yoke and an inner wall of the permanent magnet and the top plate and wherein the through hole extends along the height of the U-Yoke, the permanent magnet and the top plate; and wherein the lead wire guide fixture is positioned at least partially within the through hole.

* * * * *